US010639604B2

(12) United States Patent
Zuo et al.

(10) Patent No.: US 10,639,604 B2
(45) **Date of Patent: *May 5, 2020**

(54) LABOR-SAVING PAINT MIXING COVER

(71) Applicant: ZHENGZHOU SANHUA TECHNOLOGY & INDUSTRY CO., LTD., Xinyang, Henan (CN)

(72) Inventors: Hanlu Zuo, Henan (CN); Yiyang Yu, Henan (CN)

(73) Assignee: ZHENGZHOU SANHUA TECHNOLOGY & INDUSTRY CO., LTD., Xingyang, Henan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/320,866

(22) PCT Filed: Jul. 25, 2017

(86) PCT No.: PCT/CN2017/094252

§ 371 (c)(1),
(2) Date: Jan. 25, 2019

(87) PCT Pub. No.: WO2018/019221

PCT Pub. Date: Feb. 1, 2018

(65) Prior Publication Data

US 2019/0168179 A1 Jun. 6, 2019

(30) Foreign Application Priority Data

Jul. 27, 2016 (CN) ..... 2016 1 0598470

(51) Int. Cl.
*B01F 15/00* (2006.01)
*B44D 3/12* (2006.01)
(Continued)

(52) U.S. Cl.
CPC ..... *B01F 15/00805* (2013.01); *B01F 7/00* (2013.01); *B01F 7/18* (2013.01);
(Continued)

(58) Field of Classification Search
CPC ..... B01F 15/00805; B01F 7/00; B01F 7/18; B01F 2015/00084; B01F 2215/005; B44D 3/12; B65D 51/14; B65D 51/24
(Continued)

(56) References Cited

U.S. PATENT DOCUMENTS 1,486,199 A * 3/1924 Skiles ..... B65D 17/28
222/482
1,731,764 A * 10/1929 Coffin ..... A47G 19/183
137/533.27
(Continued)

FOREIGN PATENT DOCUMENTS

CN 1216023 5/1999
CN 2458244 11/2001
(Continued)

OTHER PUBLICATIONS

International Search Report, issued in the corresponding PCT application No. PCT/CN2017/094252, dated Nov. 9, 2017, 6 pages.

*Primary Examiner* — Benjamin R Shaw
(74) *Attorney, Agent, or Firm* — Hamre, Schumann, Mueller & Larson, P.C.

(57) ABSTRACT

Labor-saving paint mixing cover comprises a paint outlet mechanism used to control outflow of a paint material, two or more pressing mechanisms pressing together a paint container and a cover. Each of the pressing mechanisms comprises: a through hole on the cover; a pressing rod passing through the through hole; a sealing sleeve sleeved over the pressing rod, and comprising a sealing sleeve folded edge pressing on the cover; a compression spring sleeved
(Continued)

over the pressing rod between the sealing sleeve folded edge of the sealing sleeve and a handle at the upper end of the pressing rod; and a pressing foot located at the lower end of the pressing rod. The handle at the upper end of the pressing rod is a cam lifting handle comprising the upper end of the pressing rod and a cam hinged thereto. A cam surface of the cam lifting handle is in contact with an upper surface of a cam base. The cam base is a movable sleeve sleeved around the pressing rod. A movable sleeve folded edge is provided on the movable sleeve. An upper end of the compression spring presses against said folded edge of the movable sleeve.

2 Claims, 3 Drawing Sheets

(51) Int. Cl.
*B65D 51/14* (2006.01)
*B01F 7/00* (2006.01)
*B01F 7/18* (2006.01)

(52) U.S. Cl.
CPC ..... *B44D 3/12* (2013.01); *B65D 51/14* (2013.01); *B01F 2015/00084* (2013.01); *B01F 2215/005* (2013.01)

(58) Field of Classification Search
USPC ..... 222/567
See application file for complete search history.

(56) References Cited

U.S. PATENT DOCUMENTS

| | | | | | |
|---|---|---|---|---|---|
| 1,805,257 | A * | 5/1931 | Pitt | B65D 47/249 | 215/315 |
| 3,162,338 | A * | 12/1964 | Grubelic | B01F 7/1695 | 220/325 |
| 5,368,388 | A * | 11/1994 | Fillon | B01F 7/1695 | 366/197 |
| 5,533,802 | A * | 7/1996 | Garganese | B01F 11/0082 | 366/256 |
| 7,540,652 | B2 * | 6/2009 | Krzywdziak | B44D 3/127 | 220/780 |
| 2002/0145939 | A1 * | 10/2002 | Keough | B01F 7/1695 | 366/247 |
| 2006/0000838 | A1 * | 1/2006 | Santrach | B01F 7/1695 | 220/700 |
| 2006/0027580 | A1 * | 2/2006 | Keough | B44D 3/127 | 220/212 |
| 2015/0314256 | A1 * | 11/2015 | Boothman | B01F 7/0005 | 366/192 |
| 2019/0160486 | A1 * | 5/2019 | Zuo | B01F 7/1695 | |

FOREIGN PATENT DOCUMENTS

| | | |
|---|---|---|
| CN | 2490086 | 5/2002 |
| CN | 2595461 | 12/2003 |
| CN | 2595706 | 12/2003 |
| CN | 203020695 | 6/2013 |
| CN | 203998869 | 12/2014 |
| JP | 2008-168911 | 7/2008 |

* cited by examiner

LABOR-SAVING PAINT MIXING COVER

FIELD OF THE INVENTION

The present invention relates to a canister lid for a paint mixing stirrer. The canister lid can be clamped on and cover a paint bucket and achieve control of colored paint stirring and the pouring-out quantity of a colored paint.

BACKGROUND OF THE INVENTION

A paint mixing stirrer is common equipment in the automobile repair industry. A canister lid for a paint bucket uses a knob wrench thereon to clamp a presser foot onto the paint bucket, and then they are placed on the paint mixing stirrer, which rotates blades of the canister lid, to achieve stirring of a colored paint in the colored paint bucket. At present, a patent entitled "Canister lid of colored paint bucket with anti-drop pressure lever fixing seat" (application No.: CN02290592.8) discloses a canister lid of a colored paint bucket, which is very good in the control of paint mixing and pouring-out quantity, wherein the lid of the paint container has both functions of sealing the container and precisely controlling the pouring-out flow. A canister lid body is provided with a paint outlet mechanism, including an outlet on the lid body for pouring out the contained substance, wherein the outlet is covered with a slidable covering plate with a sealing function. The covering plate is connected to a manual press wrench through a resilient U-shaped torsional spring. When the container is inclined and the wrench is pressed, the slidable covering plate can be opened. At that time, the outlet of the lid is opened, and the contained substance (i.e. liquid paint) flows out from a liquid pouring port. The angle of the press wrench can control the stroke of the slidable covering plate, so that the covering plate and the lid outlet are opened a controlled outlet size to control the pouring-out flow. To ensure that the contained substance flows out smoothly and is not blocked, a gas intake hole is formed on the other side of the pouring-out port, so that during the pouring-out process, air can enter the closed container with the pouring out of the poured-out substance. In this way, the contained substance is poured out smoothly. The gas inlet hole is closed by a tapered plug fixed on the wrench when the contained substance is not poured out from the canister lid. The gas inlet hole is opened only when the covering plate is opened by the press wrench to pour out the contained substance.

The canister lid body is further provided with a pressing mechanism, including a through hole formed on the canister lid, wherein a seal sleeve is arranged in the through hole; a pressing lever is arranged in the seal sleeve; a handle is provided on the upper end of the pressing lever; a spring is sleeved outside the pressing lever between the seal sleeve and the handle; and a presser foot is provided at the lower end of the pressing lever. During assembly with the colored paint bucket opening, the handle needs to be pressed down manually with force and fixed, so that the spring is pressed to retain a space for cooperation between the presser foot and the paint bucket. Then the handle is rotated, so that the presser foot moves to a location below the paint bucket opening. Finally, the handle is released by the hand, the spring is reset, and the presser foot clamps the colored paint bucket opening, thus completing the assembly.

However, there are shortcomings: when the canister lid is compressed, the knob also needs to be pressed and rotated to ensure the presser foot is clamped on the paint bucket. Often, to ensure the sealing performance of the banister lid, the compressed spring of the knob is designed to have great elasticity. When the knob is rotated, the compressed spring needs to be pressed continuously. This can generate a very large counteracting force on the finger. The hand is squeezed and the operation is strenuous, and a person feels very uncomfortable in the case of repeated installation.

SUMMARY OF THE INVENTION

The present invention needs to solve the present technical problem of being very strenuous.

A technical solution of the present invention is specifically: a stirring canister lid adapted to different paint bucket openings, comprising a paint outlet mechanism for controlling a paint to be poured out, and at least two pressing mechanisms for pressing a paint bucket and the canister lid, wherein for each pressing mechanism, the canister lid is provided with a through hole; a pressing lever penetrates through the through hole; a seal sleeve is sleeved outside the pressing lever; a seal sleeve turnup of the seal sleeve is pressed against the canister lid; a compressed spring is sleeved at the outer periphery of the pressing lever between the seal sleeve turnup of the seal sleeve and an upper end of the pressing lever; a presser foot is provided at a lower end of the pressing lever, characterized in that a handle is provided at an upper end of the pressing lever and is a cam lifting handle formed by hinging the upper end of the pressing lever and a cam; a cam surface of the cam lifting handle is in contact with an upper surface of a cam seat; the cam seat is a movable pipe sleeve sleeved outside the pressing lever; an upper surface of the movable pipe sleeve is in contact with the cam surface of the cam lifting handle; the movable pipe sleeve is provided with a movable pipe sleeve turnup; and the upper end of the pressing spring abuts against the movable pipe sleeve turnup of the movable pipe sleeve.

In the case of the stirring canister lid adapted to different paint bucket openings, a bracket is provided correspondingly above the through hole of the canister lid; an upper flat plate of the bracket is provided with a bracket through hole; the movable pipe sleeve is placed in the bracket through hole; and the movable pipe sleeve and the bracket through hole are in sliding fit to each other. As such, the whole pressing mechanism is supported by the upper through hole and the lower through hole, and is relatively firm.

Compared with the prior art, the utility model has the beneficial effects that with this configuration, when the lifting handle is pressed down to a dead point, the presser foot stretches down, the pressing lever does not needs to be pressed, and it only needs to rotate the pressing lever so that the presser foot turned to a location below the paint bucket opening; and when the lifting handle is pushed up to a relaxed state, the compressed spring causes the presser foot to press against the paint bucket opening, which is labor-saving.

DETAILED DESCRIPTION OF THE EMBODIMENTS

Figure 1:
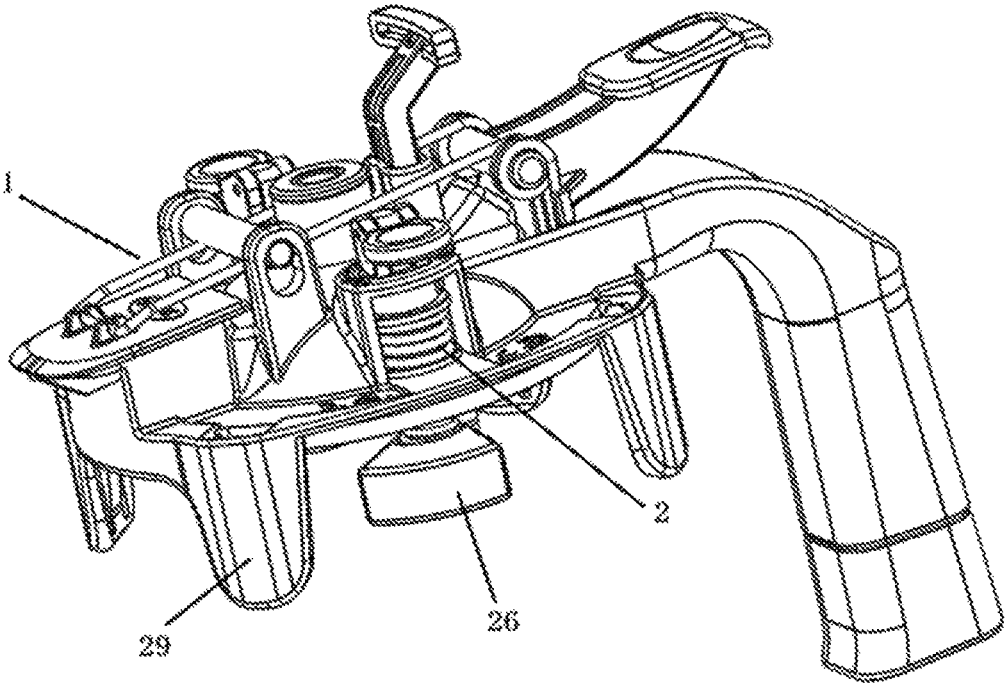
FIG. 1 is a structure diagram of the present invention.
Figure 2:
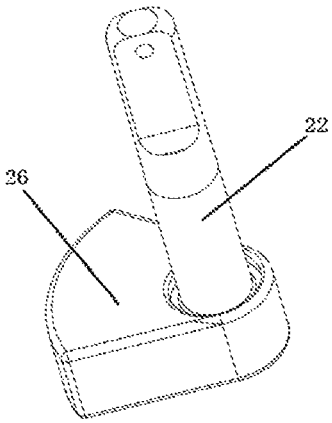
FIG. 2 is a structure diagram of a pressing lever and a presser foot.
Figure 3:
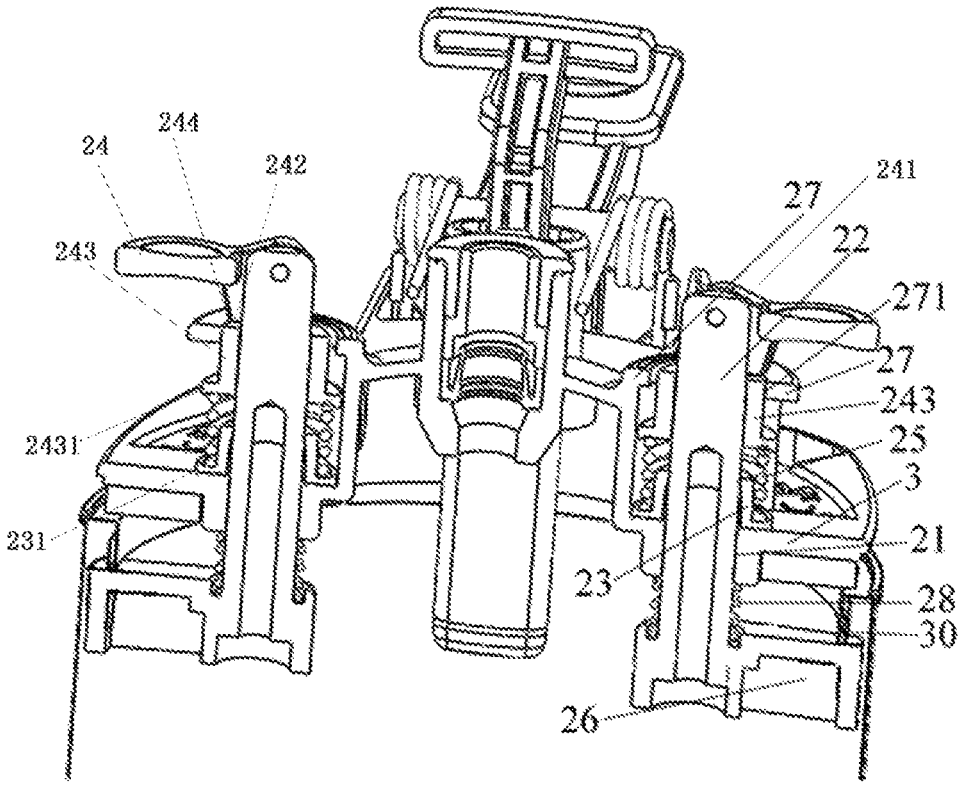
FIG. 3 is a sectional structure diagram of a lifting handle with a cam in the present invention.
Figure 4:
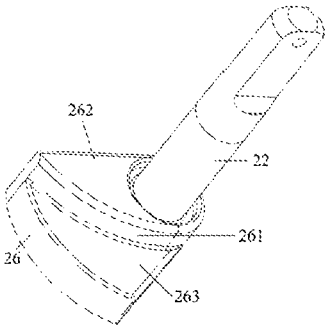
FIG. 4 is a structure diagram of a pressing lever and a stepped presser foot at an end thereof.

As shown in FIGS. 1-6, a labor-saving paint mixing cover adapted to different paint bucket openings includes a paint outlet mechanism 1 for controlling a paint to be poured out, and at least two pressing mechanisms 2 for pressing a paint bucket and the canister lid, wherein for each pressing mechanism, the canister lid is provided with a through hole 21; a pressing lever 22 penetrates through the through hole; a seal sleeve 23 is sleeved outside the pressing lever 22; a seal sleeve turnup 231 of the seal sleeve 23 is pressed against the canister lid 3; a compressed spring 25 is sleeved at the outer periphery of the pressing lever 22 between the seal sleeve turnup 231 of the seal sleeve 23 and an upper end of the pressing lever 22; a presser foot 26 is provided at a lower end of the pressing lever 22, characterized in that a handle is provided at an upper end of the pressing lever and is a cam lifting handle 241 formed by hinging the upper end of the pressing lever and a cam; a cam surface 242 of the cam lifting handle 241 is in contact with an upper surface of a cam seat; the cam seat is a movable pipe sleeve 243 sleeved outside the pressing lever; an upper surface 244 of the movable pipe sleeve 243 is in contact with the cam surface 242 of the cam lifting handle; the movable pipe sleeve 243 is provided with a movable pipe sleeve turnup 2431; and the upper end of the pressing spring 25 abuts against the movable pipe sleeve turnup 2431 of the movable pipe sleeve 243.

In the prior art, when the lid is compressed, the knob also needs to be pressed and rotated to ensure the presser foot is clamped on the paint bucket 301. Often, to ensure the sealing performance of the banister lid, the compressed spring of the knob is designed to have great elasticity. When the knob is rotated, the compressed spring needs to be pressed continuously. This can generate a very large counteracting force on the finger. The hand is squeezed and the operation is strenuous, and a person feels very uncomfortable in the case of repeated installation. As the cam lifting handle is adopted, when the spring is pressed, a long shaft of the cam lifting hand is in contact with the upper surface of the cam seat; at that time, the cam lifting handle is horizontally rotated, so that the presser foot presses against the paint bucket opening; in the entire horizontal rotation process, the hand only needs to hold the handle part to avoid return of the cam, so that the compressed spring is pressed continuously, and the working pressure of the finger is reduced, thereby saving physical work and facilitating operation.

A bracket 27 is provided correspondingly above the through hole 21 of the canister lid 3; an upper flat plate of the bracket 27 is provided with a bracket through hole 271; the movable pipe sleeve 243 is placed in the bracket through hole 271; and the movable pipe sleeve 243 and the bracket through hole 271 are in sliding fit to each other. As such, the whole pressing mechanism is supported by the upper through hole and the lower through hole, and is relatively firm. A reset spring 28 is sleeved at the outer periphery of the pressing lever between the lower side of the canister lid and the presser foot. With this design, the pressing mechanism can be prevented from moving when the presser foot is in a relaxed state. There are two or four pressing mechanisms.

When the canister lid is mounted on the paint bucket 301, firstly it needs to manually adjust the canister lid to be concentric to the paint bucket with visual inspection, to ensure the canister lid is mounted in place without offset; otherwise, a leakage event may occur. At least three clamping jaws 29 are provided at the periphery of the canister lid. When the stirring canister lid works, the plurality of clamping jaws surround the outer side of the paint bucket, and the canister lid can be adjusted to be concentric to the paint bucket. Four clamping jaws are added to the new structure of the canister lid. When the canister lid is sleeved on the paint bucket, center adjustment can be achieved to ensure the canister lid is centered, without manually adjusting the position of the canister lid to be centered, wherein four clamping jaws with the same size are uniformly distributed around the canister lid; and when canister lid is sleeved on the paint bucket, the four clamping jaws can be automatically pressed uniformly into a groove according to the outer diameter of the paint bucket, to ensure the canister lid is sleeved in a centered manner.

The separation of the knob rotating and knob pressing operations is achieved as follows:

The canister lid adopts a novel sealing structure suitable for a paint container and a canister lid, and comprises lid body in sealed connection with the container, and a knob, springs, a presser foot, a seal ring and the like for cooperative operation of an upper and a lower surface of the lid body. First, the lid body is provided with a special structure for installing the seal ring, the compressed spring and a locking support. With this structure, the three workpieces can be assembled and connected from bottom to top, and the compressed spring can bidirectionally tighten the seal ring at the lower end and the locking support at the upper end. Then, the presser foot and the reset spring are mounted at the lower end of the lid body. The two workpieces penetrate through the lid body and the afore-mentioned seal ring. The spring and other parts are connected to the knob at the upper end of the lid body. By rotating the knob, the presser foot is rotated, and contraction of the presser foot is controlled. After the presser foot rotates in place, a knob pressing platform is pressed down, and by using the cam lifting handle on the knob, the compressed spring and the locking support, the presser foot is lifted up, so that the seal ring and a lower edge 30 of a boss of the paint bucket opening completely fit to each other to achieve a sealing effect. To change the paint bucket, first, the knob pressing platform is lifted up, the presser foot is pushed out by using the reset spring between the presser foot and the lid body, and then the cam lifting handle is rotated in a reversed direction to contract the presser foot, and the paint bucket can be changed.

The utility model achieves automatic centering in canister lid product installation, and achieves separation of pressing and rotating operations in the canister installation. The operation is easy and quick.

The presser foot surface is sector-ring-shaped, and is provided with a vertical surface 261 along a connecting line between two arc lines in the shape of section rings. The vertical surface 261 divides the sector-ring surface into two presser foot surfaces with different heights and in a stepped manner, that is, a first presser foot 262 and a second presser foot 263.

With this design, using multiple pressing surfaces, the same presser foot can be used to press paint buckets with different paint bucket opening thicknesses, unlike the prior art in which one presser foot can only be used to press paint buckets with the same bucket opening thickness. This configuration adopts the presser foot with a two-segment structure, which can be adapted to paint buckets with different clamping heights, improve the universality. The presser foot with the new structure is specially designed with two working surfaces with different heights, and the upper and lower working surfaces are spaced from the fitting surface of the seal right by different heights. This leads to an advantage that it can be adapted to paint buckets with different clamping heights from different customers. When the clamping height of the paint bucket of the customer is less than 7 mm, the upper plane can used to fit to and seal the paint bucket. When the clamping height of the paint bucket of the customer is more than 7 mm and less than 12 mm, the lower plane is used to fit to and seal the paint bucket. Designing the presser feet of the canister lid into presser feet with different heights and different specifications can achieve compatibility.

Figure 5:
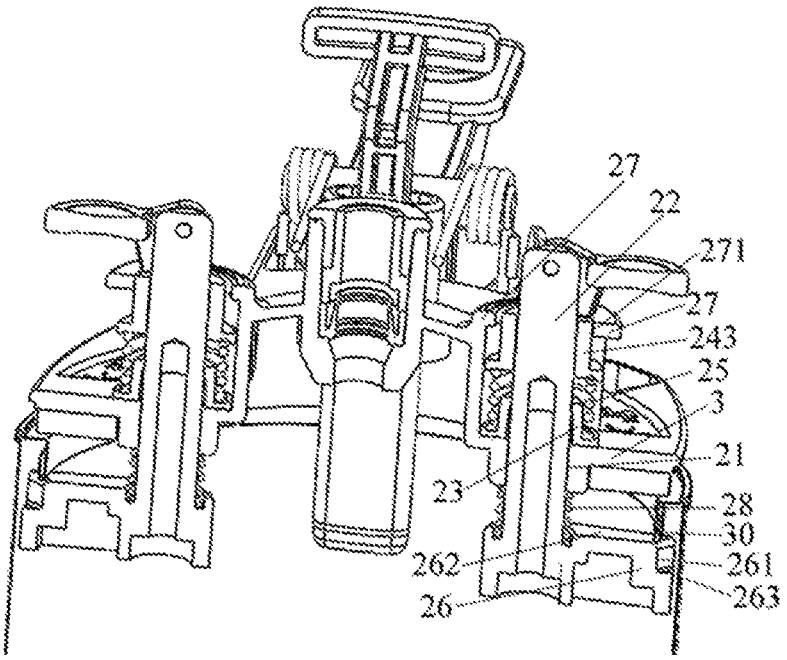
FIG. 5 is an isometric sectional structure diagram of a first presser foot surface pressing against a paint bucket opening.
Figure 6:
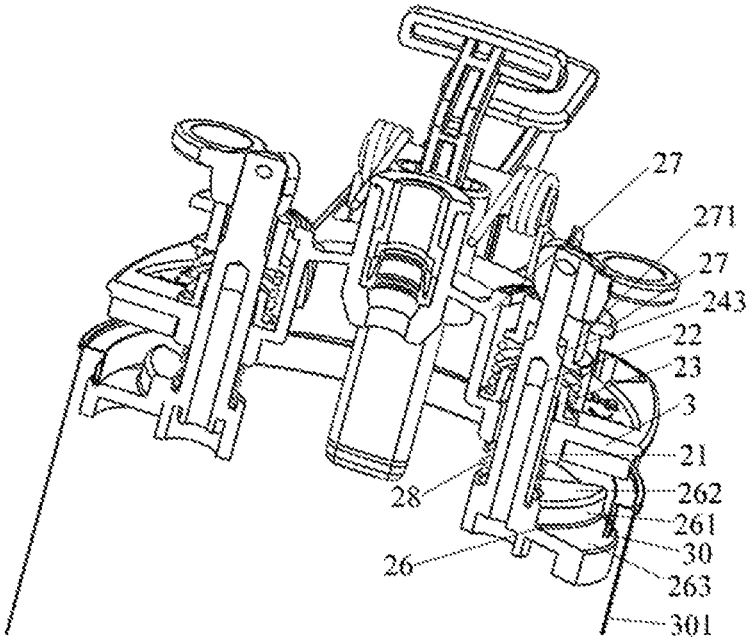
FIG. 6 is an isometric sectional structure diagram of a second presser foot surface pressing against a paint bucket opening.

In the prior art, when the lid is compressed, the knob also needs to be pressed and rotated to ensure the presser foot is clamped on the paint bucket. Often, to ensure the sealing performance of the banister lid, the compressed spring of the knob is designed to have great elasticity. When the knob is rotated, the compressed spring needs to be pressed continuously. This can generate a very large counteracting force on the finger. The hand is squeezed and the operation is strenuous, and a person feels very uncomfortable in the case of repeated installation. As the cam lifting handle is adopted, when the spring is pressed, a long shaft of the cam lifting hand is in contact with the upper surface of the cam seat; at that time, the cam lifting handle is horizontally rotated, so that the presser foot presses against the paint bucket opening. FIG. 5 is an isometric sectional structure diagram of a first presser foot surface pressing against a paint bucket opening. FIG. 6 is an isometric sectional structure diagram of a second presser foot surface pressing against a paint bucket opening. In the entire horizontal rotation process, the hand only needs to hold the handle part to avoid return of the cam, so that the compressed spring is pressed continuously, and the working pressure of the finger is reduced, thereby saving physical work and facilitating operation.

There are three or four clamping jaws 29.

The present application is specially directed to the newest universal canister lid of the company. The new structure can adapt to paint buckets of most brands in the market, does not need secondary processing or adjustment and is highly universal. Moreover, the canister lid is simple to operate and good in operation handfeel, and eliminates the shortcoming that the hand is squeezed during pressing and rotating operations of the previous canister lids.

The invention claimed is:

1. Labor-saving paint mixing cover, comprising a paint outlet mechanism for controlling a paint to be poured out, and at least two pressing mechanisms for pressing a paint bucket and a canister lid, wherein for each pressing mechanism, the canister lid is provided with a through hole; a pressing lever penetrates through the through hole; a seal sleeve is sleeved outside the pressing lever; a seal sleeve turnup of the seal sleeve is pressed against the canister lid; a compressed spring is sleeved at an outer periphery of the pressing lever between the seal sleeve turnup of the seal sleeve and an upper end of the pressing lever; a presser foot is provided at a lower end of the pressing lever, characterized in that a handle is provided at an upper end of the pressing lever and is a cam lifting handle formed by hinging the upper end of the pressing lever and a cam; a cam surface of the cam lifting handle is in contact with an upper surface of a cam seat; the cam seat is a movable pipe sleeve sleeved outside the pressing lever; an upper surface of the movable pipe sleeve is in contact with the cam surface of the cam lifting handle; the movable pipe sleeve is provided with a movable pipe sleeve turnup; and the upper end of the pressing spring abuts against the movable pipe sleeve turnup of the movable pipe sleeve.

2. The labor-saving paint mixing cover of claim 1, wherein a bracket is provided correspondingly above the through hole of the canister lid; an upper flat plate of the bracket is provided with a bracket through hole; the movable pipe sleeve is placed in the bracket through hole; and the movable pipe sleeve and the bracket through hole are in sliding fit to each other.

* * * * *